US006595290B2

(12) United States Patent
George et al.

(10) Patent No.: US 6,595,290 B2
(45) Date of Patent: Jul. 22, 2003

(54) INTERNALLY ORIENTED PERFORATING APPARATUS

(75) Inventors: Flint R. George, Flower Mound, TX (US); Melissa G. Allin, Comanche, OK (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/995,902

(22) Filed: Nov. 28, 2001

(65) Prior Publication Data

US 2003/0098158 A1 May 29, 2003

(51) Int. Cl.[7] ..... E21B 43/119
(52) U.S. Cl. ..... 166/297; 166/55.1; 166/255.2
(58) Field of Search ..... 166/297, 298, 166/55, 55.1, 255.2

(56) References Cited

U.S. PATENT DOCUMENTS

| | | | |
|---|---|---|---|
| 3,704,749 | A | 12/1972 | Estes et al. |
| 4,194,577 | A | 3/1980 | Vann |
| 4,269,278 | A | 5/1981 | Vann |
| 4,637,478 | A | 1/1987 | George |
| 5,010,964 | A | 4/1991 | Cornette |
| 5,259,466 | A | 11/1993 | Venditto et al. |
| 5,964,294 | A | 10/1999 | Edwards et al. |
| 6,003,599 | A | 12/1999 | Huber et al. |

FOREIGN PATENT DOCUMENTS

| | | | |
|---|---|---|---|
| GB | 2128719 | * | 5/1984 |

* cited by examiner

*Primary Examiner*—William Neuder
(74) *Attorney, Agent, or Firm*—Marlin R. Smith

(57) ABSTRACT

An internally oriented perforating apparatus and associated method of perforating provide increased reliability in orienting perforating charges to shoot in desired directions in a well. In a described example, a perforating gun includes a tubular gun carrier, multiple perforating charges, multiple charge mounting structures and multiple rotating supports. The rotating supports are attached between the charge mounting structures, or at least between the perforating charges.

26 Claims, 5 Drawing Sheets

INTERNALLY ORIENTED PERFORATING APPARATUS

BACKGROUND

The present invention relates generally to operations performed and equipment utilized in conjunction with a subterranean well and, in an example described below, more specifically provides an internally oriented perforating apparatus.

It is sometimes desirable to perforate a well in a particular direction or range of directions relative to the wellbore. For example, in a deviated, inclined or horizontal well it is frequently beneficial to shoot perforating charges in a downward direction. However, certain circumstances may instead make it more beneficial to perforate in an upward direction, in a particular inclination from the upward or downward direction, or in another combination or range of directions.

To achieve this goal of perforating wells in particular directions, several attempts have been made to achieve reliable orientation of perforating charges downhole. Unfortunately, each of these has its drawbacks.

One method of orienting perforating charges downhole requires the charges to be rigidly mounted in a gun carrier so that they are pointed in the desired direction(s) relative to the carrier. The gun carrier is then conveyed into a wellbore and either laterally biased physically to one side of the wellbore so that the gun carrier seeks the lower portion of the wellbore due to gravity, or the gun carrier is rotatably supported with its center of gravity laterally offset relative to the wellbore. This method relies on the gun carrier rotating in the wellbore, so that the gun carrier may be oriented relative to the force of gravity. Frequently, such orienting rotation is unreliable due to friction between the gun carrier and the wellbore, debris in the wellbore, etc.

Another method of orienting perforating charges rotatably mounts the perforating charges in the gun carrier. The charges are mounted to a structure which extends substantially the length of the gun carrier. Rotating supports are attached at each end of the structure to permit the charges and the structure to rotate within the gun carrier due to gravity. Unfortunately, the structure is typically many feet in length and, with the charges mounted thereon, it tends to sag. This sagging of the structure permits it, or the charges mounted thereon, to contact the interior of the gun carrier. The contact prevents the charges from rotating in the gun carrier.

Therefore, an improved oriented perforating apparatus is needed. It is a purpose of the present invention to provide such an improved oriented perforating apparatus, as well as associated methods of perforating a well.

SUMMARY

The principles of the invention are demonstrated below in an example of an internally oriented perforating gun which solves the above problems in the art by rotatably supporting the perforating charges periodically between ends of a gun carrier. This distributed rotational support prevents the charges, or their mounting structures, from contacting the interior of the gun carrier and preventing charge rotation. Well perforating methods are also provided.

In one aspect, a method of perforating a subterranean well is provided by the invention. The method includes the step of rotatably supporting multiple perforating charges within a single gun carrier by attaching at least one rotating support between selected ones of the charges. Each of the charges is directed in a respective direction. The gun carrier is conveyed into the well, with the gun carrier rotating as it is conveyed into the well. The perforating charges rotate within the gun carrier as the gun carrier rotates in the well, so that each charge remains directed in its respective direction.

In another aspect, a perforating gun for use in a well is provided by the invention. The perforating gun includes a generally tubular gun carrier, multiple perforating charges, at least one charge mounting structure for positioning the charges within the gun carrier, and multiple rotating supports permitting the charges to rotate within the gun carrier. At least one of the supports is connected between adjacent charges.

In yet another aspect, a perforating gun is provided which includes a generally tubular gun carrier, multiple charge mounting structures within the gun carrier, and at least a one rotating support connected between adjacent ones of the charge mounting structures.

The perforating apparatus provided by the invention may include a special thrust bearing for use between a charge mounting structure and a tandem, bull plug or other device attached to an end of the gun carrier. A specially configured weight may be used to laterally offset a center of gravity of a rotating assembly including the charges and mounting structure. The gun carrier may be provided with reduced wall thickness portions circumscribing the perforating charges, so that as the charges rotate within the carrier, each charge remains directed to shoot through one of the reduced wall thickness portions.

These and other features, advantages, benefits and objects of the invention will be clear to a person of ordinary skill in the art after careful consideration of the description of representative examples of the invention below and the accompanying drawings.

DETAILED DESCRIPTION

Figure 1:
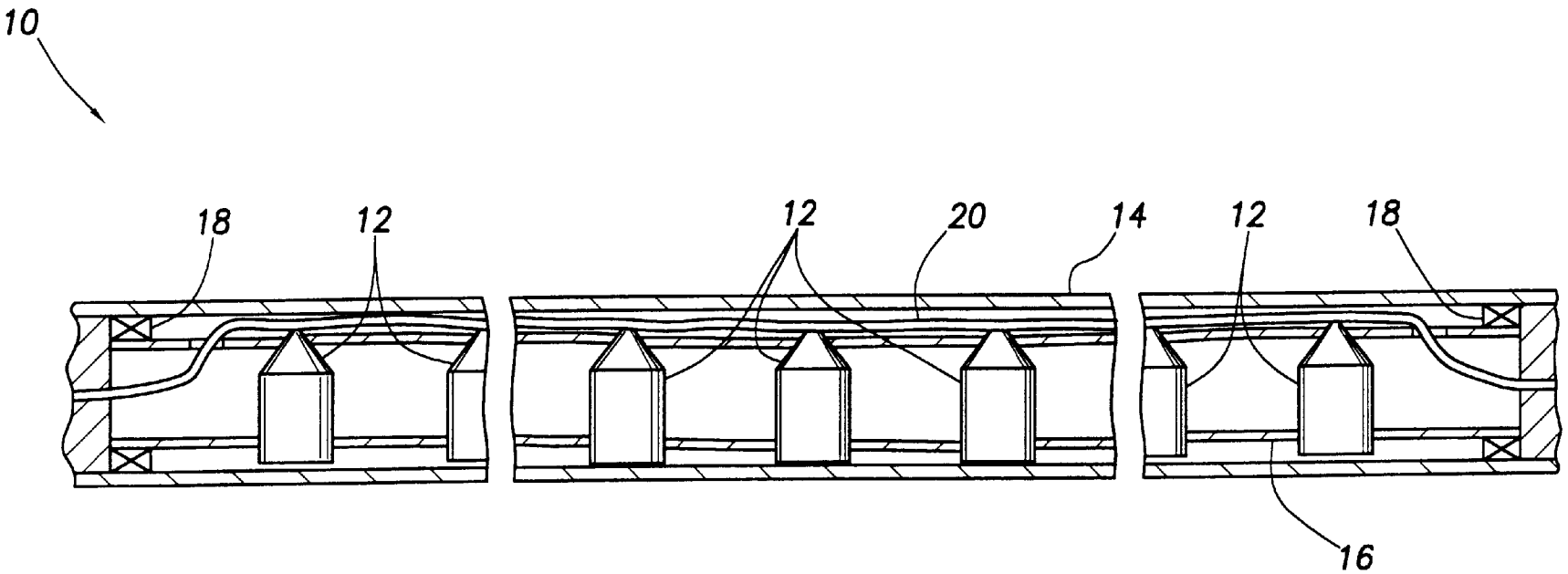
FIG. 1 is a partially cross-sectional schematic view of a perforating gun.

In FIG. 1 is shown a perforating gun lo which includes multiple perforating charges 12 rotatably mounted within a gun carrier 14. The charges 12 are mounted on a tubular charge mounting structure 16, which extends substantially from one end of the gun carrier 14 to the other. Rotating supports 18 are positioned at each end of the structure 16, so that the structure and charges 12 may rotate within the gun carrier 14.

The structure 16 may be many feet in length. Due to its own weight, the weight of the charges 12 mounted thereon, and other weights (such as detonating cord 20 routed to each charge, etc.), the structure 16 tends to sag in its middle. When the structure 16 sags, the middle charges 12, or the structure itself, contacts the interior of the gun carrier 14, which prevents the structure from rotating. This is especially problematic in highly deviated or horizontal wellbores, where the gun 10 is in its most horizontal position and gravity acts normal to the length of the structure 16 as depicted in FIG. 1.

Figure 2:
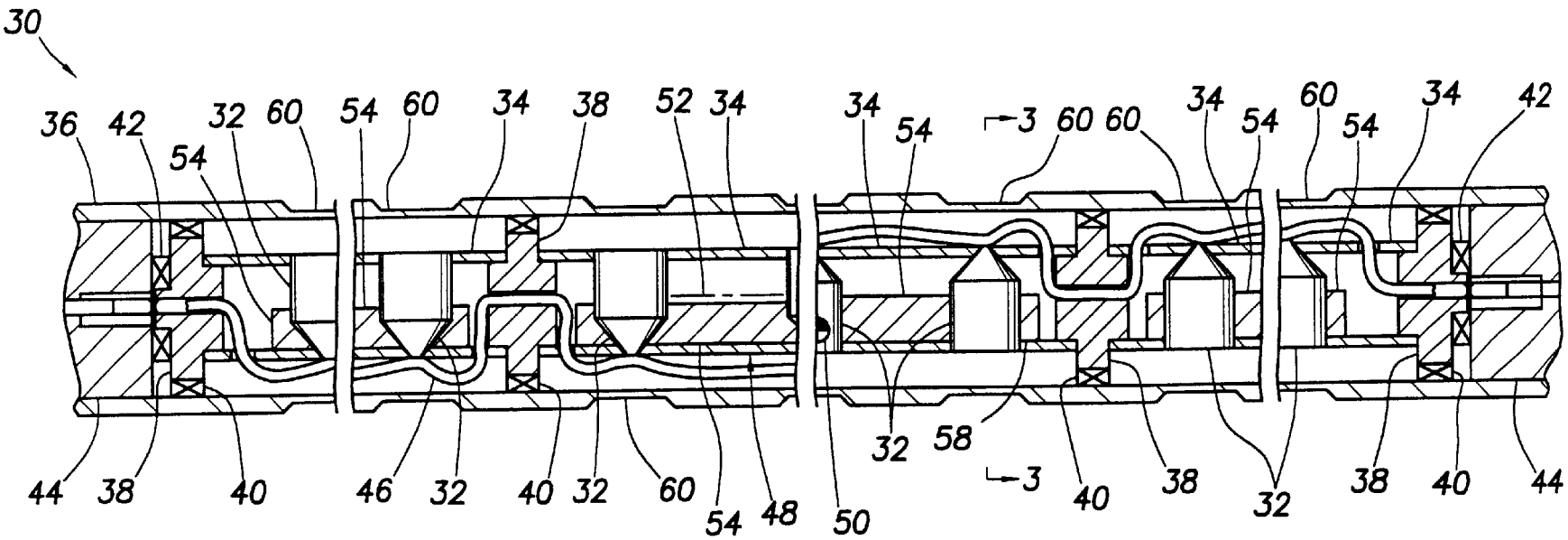
FIG. 2 is a partially cross-sectional schematic view of a perforating gun embodying principles of the present invention.

Representatively illustrated in FIG. 2 is a perforating gun 30 which embodies principles of the present invention. In the following description of the gun 30 and other apparatus and methods, directional terms (such as "above", "below", "upper", "lower", etc.) are used only for convenience in referring to the illustrations in the drawings. Additionally, it is to be understood that the various examples of the invention may be used in various orientations (such as inclined, inverted, horizontal, vertical, etc.) and in various configurations, without departing from the principles of the invention.

The gun 30 includes perforating charges 32 mounted to tubular structures 34 in a gun carrier 36. The charge mounting structures 34 are preferably made from cylindrical tubing, but it should be understood that it is not necessary for the structures to be tubular, or for the structures to be cylinder shaped, in keeping with the principles of the invention. For example, the structures 34 could be made of formed sheet metal, etc.

The structures 34 are rotatably supported in the gun carrier 36 by multiple supports 38. As depicted in FIG. 2, each of the supports 38 is connected to an end of at least one structure 34. Some of the supports 38 are connected between two of the structures 34.

This manner of rotatably supporting the multiple structures 34 at ends thereof prevents the charges 32 and structures from contacting the interior of the gun carrier 36. The charges 32 are thereby permitted to reliably rotate within the gun carrier 36, regardless of the combined length of the structures in the gun carrier.

Instead of the multiple charge mounting structures 34, the gun 30 could use a single charge mounting structure extending substantially the entire length of the gun carrier 36 (similar to the structure 16 in FIG. 1). In that case, the supports 38 would be attached periodically along the length of the structure. This would prevent the structure and/or charges 32 from contacting the interior of the gun carrier 36, while still permitting the structure and charges to rotate within the carrier.

Each of the supports 38 includes rolling elements or bearings 40 contacting the interior of the gun carrier 36. For example, the bearings 40 could be ball bearings, roller bearings, plain bearings, etc., or any other type of bearings. The bearings 40 enable the supports 38 to suspend the structures 34 in the gun carrier 36 and permit rotation of the structures.

Thrust bearings 42 are positioned between the structures 34 at each end of the gun carrier 36 and devices 44 attached at each end of the carrier. The devices 44 may be tandems (used to couple two guns to each other), a bull plug (used to terminate a gun string), a firing head, or any other type of device which may be attached to a gun carrier. As with the bearings 40 described above, the thrust bearings 42 may be any type of bearings.

The thrust bearings 42 support the structures 34 against axial loading in the carrier 36, while permitting the structures to rotate in the carrier. Although two of the thrust bearings 42 are depicted in FIG. 2, only one may be used at a lower end of the structures 34.

Any means may be used to rotate the charges 32 in the gun carrier 36. For example, an electric motor, a hydraulic actuator, gravity, or any other means may be used. The perforating gun 30 as described here uses gravity to rotate the charges 32. However, it is to be clearly understood that it is not necessary for gravity to be used to rotate the charges 32 in keeping with the principles of the invention.

The structures 34, the charges 32, and other portions of the gun 30 supported in the carrier 36 by the supports 38 (including, for example, a detonating cord 46 extending to each of the charges, and portions of the supports themselves) are parts of an overall rotating assembly 48. By laterally offsetting a center of gravity 50 of the assembly 48 relative to a longitudinal rotational axis 52 passing through the supports 38 (which is the rotational axis of the bearings 40), the assembly is biased by gravity to rotate to a specific position in which the center of gravity is located directly below the rotational axis.

The assembly 48 may, due the construction of the various elements thereof, initially have the center of gravity 50 in a desired position relative to the charges 32. However, to ensure that the charges 32 are directed to shoot in respective predetermined directions, the center of gravity 50 may be repositioned, or the biasing exerted by gravity may be enhanced, by adding one or more weights 54 to the assembly 48.

On the left-hand side of FIG. 2, weights 54 are added to the assembly 48 to direct the charges 32 to shoot upward. On the right-hand side of FIG. 2, weights 54 are added to the assembly 48 to direct the charges to shoot upward. Of course, the weights 54 may be otherwise positioned to direct the charges 32 to shoot in any desired direction, or combination of directions.

Figure 3:
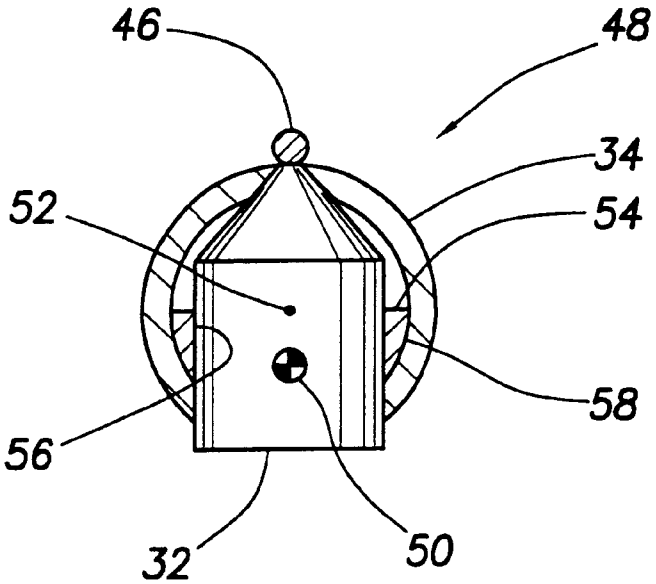
FIG. 3 is a partially cross-sectional schematic view of a portion of the perforating gun of FIG. 2, taken along line 3—3 of FIG. 2.

In FIG. 3 is shown a cross-sectional view of the assembly 48, taken along line 3—3 of FIG. 2. In this view, the spatial relationships between the charges 32, structures 34, weights 54 and the center of gravity 50 may be more clearly seen. The weight 54 laterally offsets the center of gravity 50 relative to the rotational axis 52.

Figure 4:
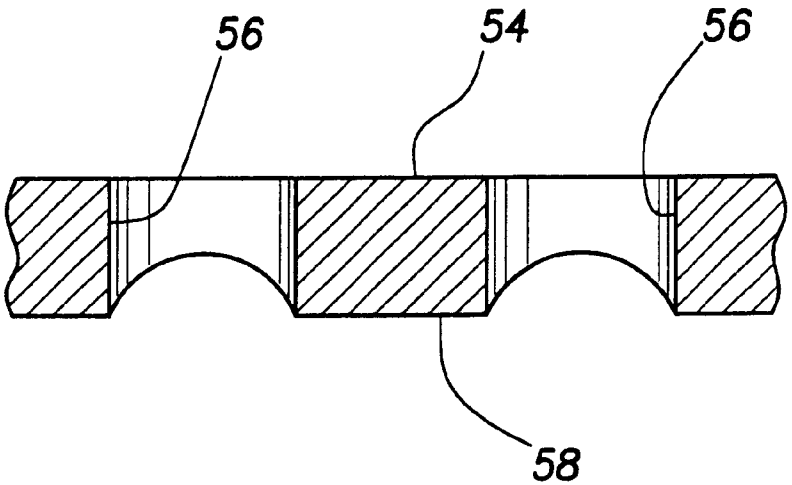
FIG. 4 is a cross-sectional view of an orienting weight used in the perforating gun of FIG. 2.

A cross-sectional view of the weight 54 is shown in FIG. 4. The weight 54 is substantially solid, but has openings 56 formed therethrough. The charges 32 are received in the openings 56, as shown in FIG. 3. The weight 54 also has a lower cylindrical outer surface 58 which conforms to the cylindrical interior of the structures 34. Of course, the weight 54 could have a differently shaped surface if, for example, the structures 34 have another shape.

Referring again to FIG. 2, the gun carrier 36 is specially configured to reduce or eliminate the detrimental effects of burrs (not shown) caused by the charges 32 when they shoot through the carrier. These burrs are well known to those skilled in the art. Burrs typically extend outwardly from the outer surface of a gun carrier surrounding a hole formed by a perforating charge. Burrs may cause the carrier to hang up on shoulders, etc. in a well, damage polished seal bores, etc.

The carrier 36 is provided with reduced wall thickness portions 60, which circumscribe each of the charges 32. The portions 60 extend circumferentially about the carrier 36 outwardly overlying each of the charges 32. Thus, as the charges 32 rotate within the carrier 36, they remain directed to shoot through the portions 60. A burr created by a charge 32 shooting through one of the portions 60 will remain below the outermost surface of the carrier 36, thereby preventing the burr from hanging up on, or damaging, anything else in a well.

The reduced wall thickness portions 60 may be formed on the carrier 36 by reducing an outer diameter of the carrier. The portions 60 could be formed on the carrier 36 by rolling, forging, lathe cutting, or any other method.

Figure 5:
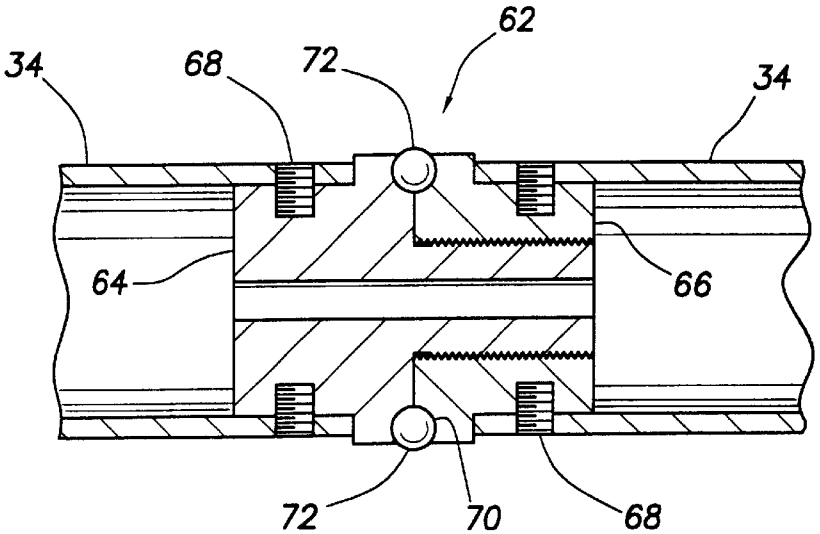
FIG. 5 is a cross-sectional view of a charge tube connector used in the perforating gun of FIG. 2.

Referring additionally now to FIG. 5, a rotating support 62 which may be used for the supports 38 in the gun 30 is representatively illustrated. The support 62 includes two portions 64, 66, one of which is connected to one structure 34, and another of which is connected to another structure, using screws 68. The portions 64, 66 are threaded to each other. It should, however, be understood that the structure 62 may include any number of portions (including one), which may be connected to each other and to the structures 34 in any manner, in keeping with the principles of the invention.

When the portions 64, 66 are threaded together, they form an annular groove 70 therebetween in which is contained multiple balls 72. The balls 72 roll against the interior of the carrier 36 when the structures 34 rotate in the carrier. Other rolling elements, such as rollers, etc., could be used in place of the balls 72.

Figure 6:
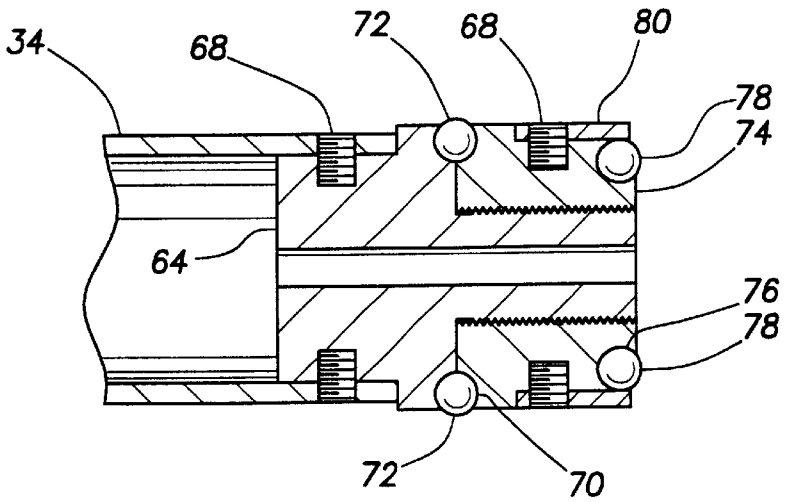
FIG. 6 is a cross-sectional view of the charge tube connector of FIG. 5, with an optional thrust load bearing attached thereto.

Referring additionally now to FIG. 6, the support 62 is depicted with another portion 74 threaded to the portion 64 in place of the portion 66. The annular groove 70 is now formed between the portions 64, 74. The portion 74 further includes an annular groove 76 at an end thereof in which multiple balls 78 are received. An outer sleeve 80 retains the balls 78 in the groove 76.

The portion 74 is used in place of the portion 66 to provide thrust bearing capability to the support 62. For example, when the support 62 is used at an end (e.g., a lower end) of the rotating assembly 48. In that case, the portion 74 with the balls 78 provide the thrust bearing 42 shown in FIG. 2.

Figure 7:
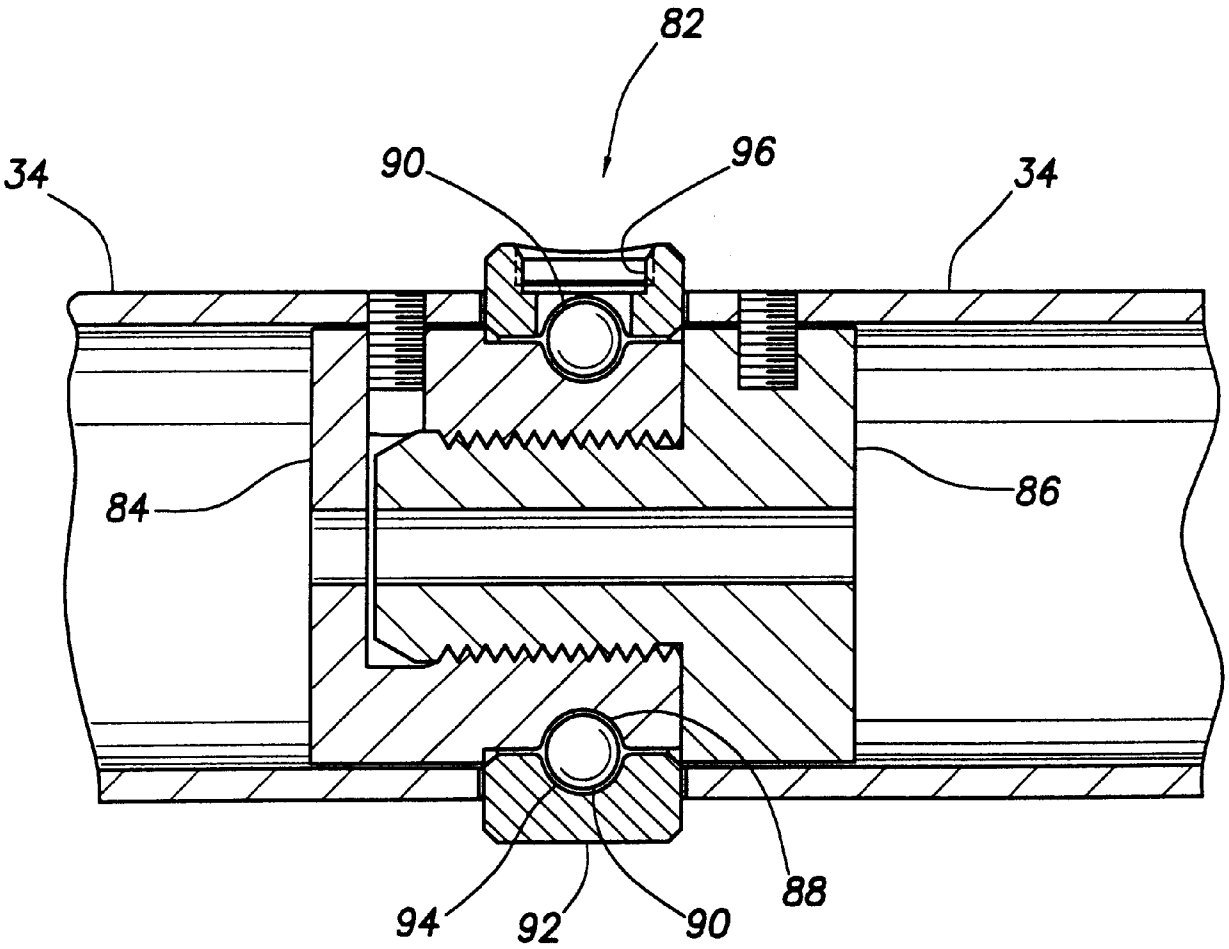
FIG. 7 is a cross-sectional view of an alternate charge tube connector for use in the perforating gun of FIG. 2.

Referring additionally now to FIG. 7, another support 82 which may be used for the supports 38 in the gun 30 is representatively illustrated. The support 82 is similar in many respects to the support 62 described above in that it includes two portions 84, 86 connected between structures 34 and threaded to each other. However, instead of forming an annular groove between the portions 84, 86, an annular groove 88 is formed externally on the portion 84.

Balls 90 roll on the groove 88 and are retained by an outer race 92. The outer race 92 has an internal groove 94 formed thereon which the balls go also roll on. The balls 90 are installed between the grooves 88, 94 via an opening 96 formed through the race 92. A plug (not shown) is used in the opening 96 to prevent the balls 90 from coming out from between the race 92 and the portion 84.

The race 92 contacts the interior of the carrier 36. When the assembly 48 rotates in the carrier, the balls 90 roll relatively frictionless against the polished grooves 88, 94, instead of against the relatively rough interior of the carrier 36.

Note that the portion 86 could be replaced with a thrust bearing 42 when used at the end of the rotating assembly 48, as with the support 62 described above.

Thus has been described the perforating gun 30 which includes rotatably supported charges 32 in a gun carrier 36. When the gun 30 is conveyed into a wellbore, the carrier 36 may rotate in the wellbore. However, the charges 32 may be rotated within the carrier 36, so that the charges are directed to shoot in a desired direction, or combination of directions. The rotating supports 38 are positioned between charges 32 and between mounting structures 34 to prevent contact with the interior of the carrier 36. The center of gravity 50 is laterally offset relative to the rotational axis 52, so that the charges 32 remain oriented to shoot in desired directions, whatever the rotational orientation of the carrier 36 in the wellbore. The carrier 36 has reduced wall thickness portions 60 about the charges 32, so that the charges will shoot through the portions, whatever the rotational orientation of the carrier 36 relative to the charges.

Only one perforating gun 30 has been described above, but it will be readily appreciated by one skilled in the art that any number of perforating guns may be interconnected in a perforating gun string. The gun string could also include other elements, such as firing heads, releases, etc. To enhance orientation in restricted areas of a wellbore, such as tight doglegs, etc., the gun string could include a knuckle joint or bi-directional explosive transfer apparatus as described in a patent application entitled BI-DIRECTIONAL EXPLOSIVE TRANSFER SUBASSEMBLY AND METHOD FOR USE OF SAME, filed Oct. 19, 2001. The entire disclosure of this copending application is incorporated herein by this reference.

Of course, a person skilled in the art would, upon a careful consideration of the above description of representative examples of the invention, readily appreciate that many modifications, additions, substitutions, deletions, and other changes may be made to these specific examples, and such changes are encompassed by the principles of the invention. Accordingly, the foregoing detailed description is to be clearly understood as being given by way of illustration and example only, the spirit and scope of the invention being limited only by the following claims and their equivalents.

What is claimed is:

1. A method of perforating a subterranean well having a wellbore, the method comprising the steps of:

rotatably supporting multiple perforating charges within a single gun carrier by attaching at least one rotating support between selected ones of the charges;

conveying the gun carrier into the well, the gun carrier rotating as it is conveyed into the well; and rotating the perforating charges within the gun carrier, so that each charge is directed to shoot in a respective predetermined direction relative to the wellbore, the rotatably supporting step further comprising mounting the charges so that each one is directed to shoot in its respective direction relative to the wellbore due to gravity, the mounting step further comprising installing the charges on multiple structures suspended between the rotating supports, and laterally offsetting a center of gravity relative to an axis extending through each of the rotating supports, the laterally offsetting step comprising attaching a weight to at least one of the structures, and the weight attaching step further comprising receiving at least one of the charges into an opening formed through the weight.

2. A method of perforating a subterranean well having a wellbore, the method comprising the steps of:

rotatably supporting multiple perforating charges within a single gun carrier by attaching at least one rotating support between selected ones of the charges;

conveying the gun carrier into the well, the gun carrier rotating as it is conveyed into the well;

rotating the perforating charges within the gun carrier, so that each charge is directed to shoot in a respective predetermined direction relative to the wellbore; and providing multiple annular reduced wall thickness portions on the gun carrier, the rotatably supporting step further comprising positioning each of the charges within a respective one of the reduced wall thickness portions.

3. The method according to claim 2, wherein the rotating step further comprises rotating each charge within its respective reduced wall thickness portion, so that each charge remains directed to shoot through its respective reduced wall thickness portion.

4. The method according to claim 2, wherein the providing step further comprises forming the reduced wall thickness portions by reducing an outer diameter of the gun carrier at each reduced wall thickness portion.

5. A perforating gun for use in a subterranean well, comprising:

a generally tubular gun carrier;

multiple perforating charges;

at least one charge mounting structure for positioning the charges within the gun carrier; and multiple rotating supports permitting the charges to rotate within the gun carrier, at least one of the supports being connected between adjacent charges, the charges and the mounting structure being part of a rotating assembly which has a center of gravity laterally offset relative to a longitudinal axis of the rotating supports, the rotating assembly including a weight which laterally offsets the center of gravity relative to the axis of the rotating supports, and the weight having a body with an opening formed therethrough, at least one of the charges being positioned in the opening.

6. The perforating gun according to claim 5, wherein the weight body is positioned within the charge mounting structure.

7. A perforating gun for use in a subterranean well, comprising:

a generally tubular gun carrier;

multiple perforating charges;

at least one charge mounting structure for positioning the charges within the gun carrier;

multiple rotating supports permitting the charges to rotate within the gun carrier, at least one of the supports being connected between adjacent charges, the charges and the mounting structure being part of a rotating assembly which has a center of gravity laterally offset relative to a longitudinal axis of the rotating supports; and a thrust bearing positioned between an end of the rotating assembly and a surface formed on a device attached to an end of the gun carrier, the thrust bearing being attached directly to one of the rotating supports.

8. A perforating gun for use in a subterranean well, comprising:

a generally tubular gun carrier;

multiple perforating charges;

at least one charge mounting structure for positioning the charges within the gun carrier; and multiple rotating supports permitting the charges to rotate within the gun carrier, at least one of the supports being connected between adjacent charges, the gun carrier including a sidewall having a reduced thickness circumscribing each perforating charge, so that each charge is directed to shoot through the reduced thickness as the charge rotates in the gun carrier.

9. A perforating gun for use in a subterranean well, comprising:

a generally tubular gun carrier;

multiple perforating charges;

at least one charge mounting structure for positioning the charges within the gun carrier; and multiple rotating supports permitting the charges to rotate within the gun carrier, at least one of the supports being connected between adjacent charges, the gun carrier including multiple reduced outer diameter portions, each of the reduced outer diameter portions outwardly overlying one of the perforating charges.

10. A perforating gun for use in a subterranean well, comprising:

a generally tubular gun carrier;

multiple charge mounting structures within the gun carrier; and at least a first rotating support connected between first and second ones of the charge mounting structures, the first rotating support including multiple balls secured in an annular space formed between first and second portions of the first rotating support.

11. The perforating gun according to claim 10, wherein the first rotating support portion is secured to the first charge mounting structure, and the second rotating support portion is secured to the second charge mounting structure.

12. The perforating gun according to claim 10, wherein the balls roll against an inner diameter of the gun carrier.

13. The perforating gun according to claim 12, further comprising a second rotating support positioned between one of the charge mounting structures and a surface formed on a device attached to an end of the gun carrier, the second rotating support including a third portion in place of the second rotating support portion, the third rotating support portion having an annular groove formed at an end thereof, a portion of the balls being received in the groove and rolling against the surface of the device to rotatably support a thrust loading on the one of the charge mounting structures.

14. The perforating gun according to claim 10, wherein the first rotating support portion is positioned between the balls and an inner diameter of the gun carrier.

15. The perforating gun according to claim 14, wherein the first rotating support portion includes an opening permitting the balls to be installed therethrough.

16. A perforating gun for use in a subterranean well, comprising:

a generally tubular gun carrier;

multiple charge mounting structures within the gun carrier;

at least a first rotating support connected between first and second ones of the charge mounting structures;

multiple perforating charges, each of the charges being mounted on one of the structures;

the perforating gun comprising multiple rotating supports, and wherein the charges and the mounting structures are part of a rotating assembly which has a center of gravity laterally offset relative to a longitudinal axis of the rotating supports, the rotating assembly including a weight which laterally offsets the center of gravity relative to the axis of the rotating supports, the weight having a body with an opening formed therethrough, at least one of the charges being positioned in the opening.

17. The perforating gun according to claim 16, wherein the weight body is positioned within at least one of the charge mounting structures.

18. A perforating gun for use in a subterranean well, comprising:

a generally tubular gun carrier;

multiple charge mounting structures within the gun carrier;

at least a first rotating support connected between first and second ones of the charge mounting structures;

multiple perforating charges, each of the charges being mounted on one of the structures, wherein the perforating gun comprises multiple rotating supports, and wherein the charges ant the mounting structures are part of a rotating assembly which has a center of gravity laterally offset relative to a longitudinal axis of the rotating supports; and a thrust bearing positioned between an end of the rotating assembly and a surface formed on a device attached to an end of the gun carrier, the thrust bearing being attached directly to one of the rotating supports.

19. A perforating gun for use in a subterranean well, comprising:

a generally tubular gun carrier;

multiple charge mounting structures within the gun carrier;

at least a first rotating support connected between first and second ones of the charge mounting structures; and multiple perforating charges, each of the charges being mounted on one of the structures, the gun carrier including a sidewall having a reduced thickness circumscribing each perforating charge, so that each charge is directed to shoot through the reduced thickness as the charge rotates in the gun carrier.

20. A perforating gun for use in a subterranean well, comprising:

a generally tubular gun carrier;

multiple charge mounting structures within the gun carrier;

at least a first rotating support connected between first and second ones of the charge mounting structures; and multiple perforating charges, each of the charges being mounted on one of the structures, the gun carrier including multiple reduced outer diameter portions, each of the reduced outer diameter portions outwardly overlying one of the perforating charges.

21. A method of perforating a subterranean well having a wellbore, the method comprising the steps of:

providing a perforating gun structure having a perforating charge supported on a gun carrier for rotation relative thereto about an axis;

conveying the gun carrier into the well; and causing the perforating charge to rotate relative to the conveyed gun carrier, so that the charge is directed to shoot in a predetermined direction relative to the wellbore, using a weight structure laterally offset from the axis and having an opening that receives the charge.

22. A method of perforating a subterranean well having a wellbore, the method comprising the step of:

providing a perforating gun structure having at least one perforating charge disposed within a gun carrier for rotation thereto about an axis;

forming at least one reduced wall thickness portion of the gun carrier;

positioning each charge within an associated reduced wall thickness portion of the gun carrier; and conveying the gun carrier into the well.

23. A method of perforating a subterranean well having a wellbore, the method comprising the steps of:

providing a perforating gun structure having a perforating charge supported on a gun carrier by a support structure rotatable relative to the gun carrier about an axis;

directly attaching a thrust bearing to the rotatable support structure, the thrust bearing operatively engaging a surface formed on a device attached to the gun carrier and axially facing the rotatable support structure; and conveying the gun carrier into the well.

24. A perforating gun for use in a subterranean well, comprising:

a gun carrier;

a perforating charge supported by the gun carrier for rotation relative thereto about an axis; and a weight structure operative to rotationally bias the perforating charge about the axis, the weight structure having an opening therein through which the charge extends.

25. A perforating gun for use in a subterranean well, comprising:

a gun carrier having at least one reduced wall thickness portion; and at least one perforating charge disposed within the gun carrier for rotation relative thereto about an axis, each charge being disposed within an associated reduced wall thickness portion of the gun carrier.

26. A perforating gun for use in a subterranean well, comprising:

a gun carrier;

a perforating charge supported on the gun carrier by a support structure rotatable relative to the gun carrier about an axis;

a device attached to the gun carrier and having a surface axially facing the support structure; and a thrust bearing directly attached to the rotatable support structure and operatively engaging the surface.

* * * * *